US009557148B2

(12) United States Patent
Ledbetter

(10) Patent No.: US 9,557,148 B2
(45) Date of Patent: Jan. 31, 2017

(54) ARROW

(71) Applicant: Bronson Blu Ledbetter, Chandler, AZ (US)

(72) Inventor: Bronson Blu Ledbetter, Chandler, AZ (US)

(73) Assignee: Bronson Blu Ledbetter, Chandler, AZ (US)

( * ) Notice: Subject to any disclaimer, the term of this patent is extended or adjusted under 35 U.S.C. 154(b) by 0 days.

(21) Appl. No.: 14/556,235

(22) Filed: Dec. 1, 2014

(65) Prior Publication Data

US 2016/0153758 A1 Jun. 2, 2016

(51) Int. Cl.

| | |
|---|---|
| ***F42B 6/04*** | (2006.01) |
| ***F42B 12/36*** | (2006.01) |
| ***F42B 12/42*** | (2006.01) |
| ***F42B 12/38*** | (2006.01) |

(52) U.S. Cl.

CPC ..... *F42B 12/362* (2013.01); *F42B 6/04* (2013.01); *F42B 12/365* (2013.01); *F42B 12/385* (2013.01); *F42B 12/42* (2013.01)

(58) Field of Classification Search

CPC ..... F42B 6/04; F42B 6/06; F42B 6/08; F42B 12/385

See application file for complete search history.

(56) References Cited

U.S. PATENT DOCUMENTS

| | | | | | |
|---|---|---|---|---|---|
| 5,157,405 | A * | 10/1992 | Wycoff | F42B 12/385 | 342/386 |
| 5,251,907 | A * | 10/1993 | Ady | F42B 12/362 | 200/61.45 M |
| 5,468,000 | A * | 11/1995 | Bennett | F42B 12/362 | 473/570 |
| 8,075,430 | B1 * | 12/2011 | Hester | F42B 12/385 | 473/578 |
| 2012/0196708 | A1 * | 8/2012 | Maddox | F42B 6/04 | 473/570 |
| 2014/0148282 | A1 * | 5/2014 | Marshall, Jr. | F42B 12/382 | 473/570 |
| 2014/0309064 | A1 * | 10/2014 | Roman | F42B 6/04 | 473/570 |
| 2015/0018141 | A1 * | 1/2015 | Bay | F42B 6/06 | 473/570 |

* cited by examiner

*Primary Examiner* — John Ricci

(57) ABSTRACT

This invention provides a novel solution for an arrow optimized for in flight and post flight tracking. The arrow comprises a module that is placed inside the arrow's shaft. The module includes several components including a position-locating device, a two-way communication device, a power source, a sound-emitting device, and a light control device. The arrow also includes lights installed on the outside of the shaft and in the nock. Finally, a software application is installed on a mobile device, wherein the software application is designed to enable communication with the two-way communication device inside of the arrow, control the light and sound emitting controllers, and to track the arrow while the arrow is in flight and after it lands.

17 Claims, 5 Drawing Sheets

ARROW

FIELD OF THE INVENTION

This invention relates generally to the field of projectiles, and specifically an arrow used for hunting and recreation.

BACKGROUND OF THE INVENTION

Mankind has used bow and arrows for hunting and recreational purposes since the earliest recorded times. The bow and arrow has been used by virtually all cultures. In many locations, including the United States of America, the rights to bear arms and hunt are highly regarded and protected individual rights. For example, the Second Amendment of the United States Constitution delineates, "the right of the people to keep and bear arms shall not be infringed." The use of bow and arrows are just as important in modern times as they have ever been.

The fundamental design of most arrows includes a point, shaft, feather, and nock. Most arrows are designed with a shaft comprising solid materials such as wood, metal, or more recently carbon fibers or composites. Arrows are also designed to be fine tuned instruments with hunting and competition arrows designed not to deviate by more than 0.02 grams from arrow to arrow in order to ensure accuracy when shot at a target. Once the arrows are shot from the bow it is difficult to track the arrows in flight and to locate the arrows after they hit the target. Thus, there is a need for an arrow that is designed to be easy to track in flight and after flight.

This invention provides a novel solution for an arrow that includes a point, feather, nock, and shaft optimized for tracking during flight and after hitting the target.

BRIEF SUMMARY OF THE INVENTION

One embodiment of the invention is an arrow optimized for in flight and post flight tracking comprising a position locating device, a two-way communication device, a power source, a sound emitting device, a light controlling device, lights, and a software application installed on a mobile device enabled to track the arrow during and after flight. First, the arrow includes a module that is placed inside of the shaft of the arrow. Next a position-locating device is installed inside the module. Next a two-way communication is inserted into the module. Next, a power source is inserted into the module. Next a sound-emitting device is installed inside the module. Next a light control device is installed inside the module. Next lights are installed and/or integrated on the outside of the shaft and in the nock. Finally, a software application is installed on a mobile device, wherein the software application is designed to enable communication with the two-way communication device inside of the arrow and to track the arrow while the arrow is in flight and after it lands.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION OF THE INVENTION

The following describes the details of the invention. Although the following description will proceed with reference being made to illustrative embodiments, many alternatives, modifications, and variations thereof will be apparent to those skilled in the art. Accordingly, it is intended that the claimed subject matter be viewed broadly. Examples are provided as reference and should not be construed as limiting. The term "such as" when used should be interpreted as "such as, but not limited to."

Figure 1:
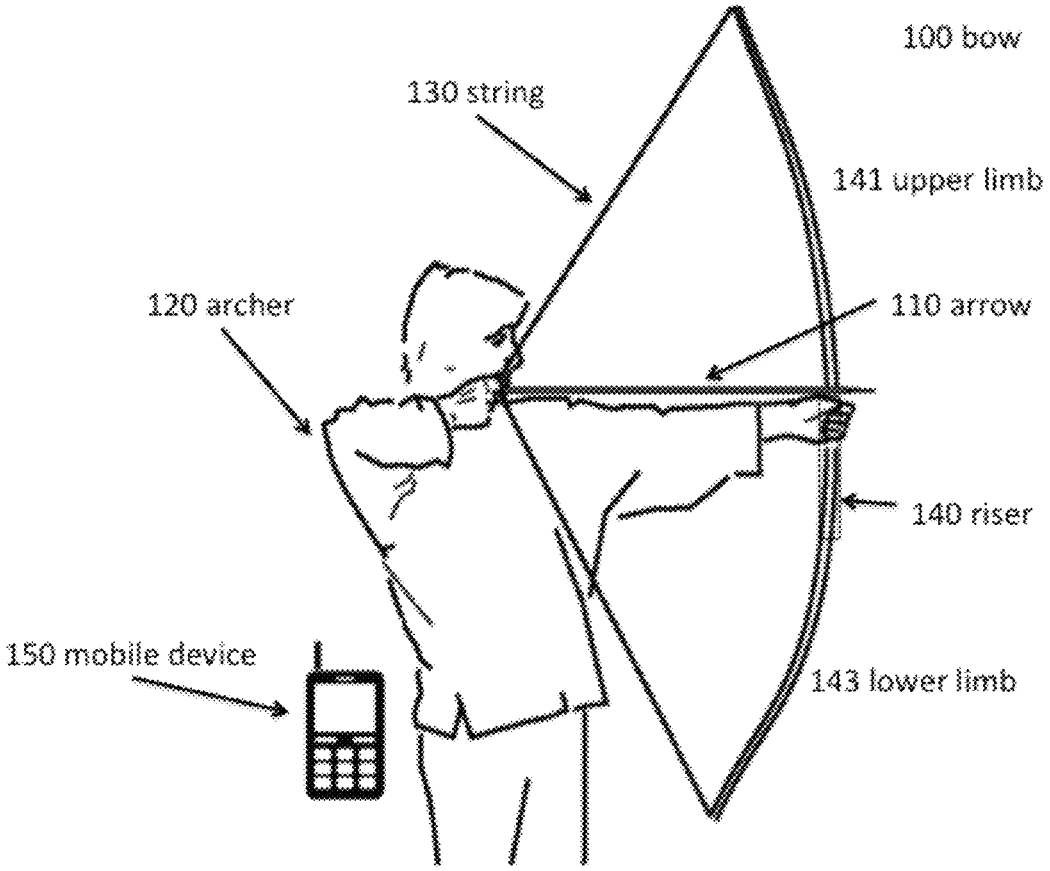
FIG. 1 is a diagram of an exemplary embodiment illustrating an archer using a bow and arrow in accordance with the teachings of the present invention.

FIG. 1 illustrates an archer 120 using a bow 100 and arrow 110 to hunt game, or shoot at targets during the sport of archery. The bow 100 typically comprises a riser 140 and string 130. The riser 140 further comprises an upper limb 141, lower limb 143, and a grip 145. The archer 120 places the arrow 110 on the arrow rest 147 of the bow 100 and attaches the nock of the arrow (see 230 of FIG. 2) to the string 130. The archer 120 then holds the arrow 110 at the nock and pulls the string 120. The archer 120 then releases the string 130 which transfers the potential energy built up in the string 130 to send the arrow 110 in flight. After the arrow 110 leaves the bow 100 it can be difficult to track during flight and after flight. For example, while hunting in a forest it is difficult to locate an arrow 110 after flight. Often times the arrow 110 strikes its target (e.g. a deer) but the animal continues running until the animal eventually succumbs to the wound caused by the arrow 110. In this example, it is difficult for the archer 120 to locate the deer and arrow 110. A solution to this problem is an arrow 110 that can be tracked and located by different methods including lights, sound, and wireless communication signals. The invention provides a novel solution for an arrow optimized for in flight and post flight tracking comprising a position-locating device, a two-way communication device, a power source, a sound-emitting device, a light-controlling device, lights, and a software application installed on a mobile device enabled to track the arrow during and after flight.

Figure 2:
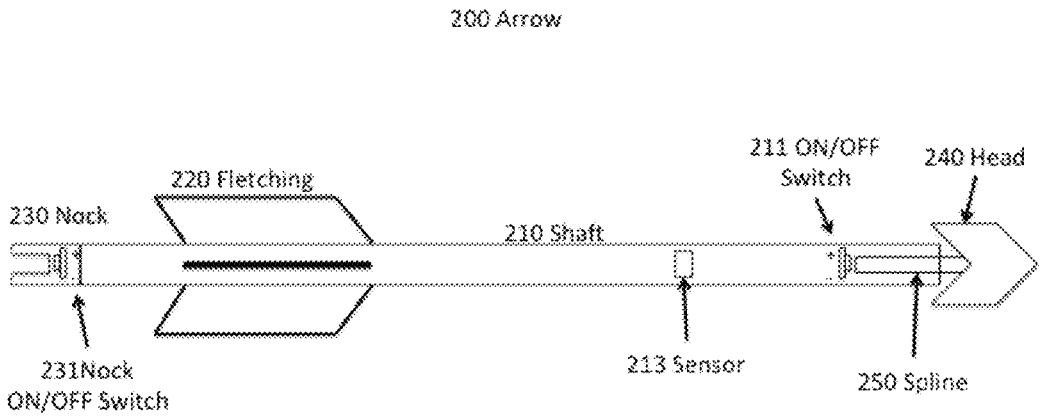
FIG. 2 is a diagram of an exemplary embodiment illustrating an arrow in accordance with the teachings of the present invention.
Figure 3:
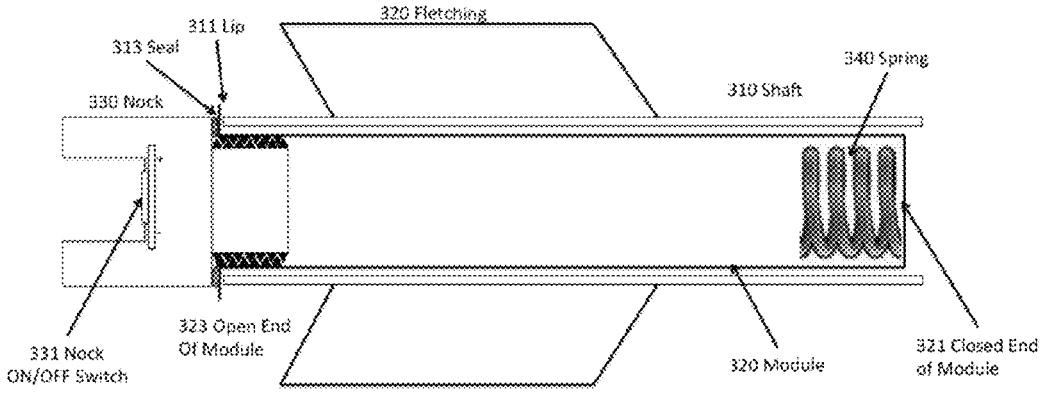
FIG. 3 is a diagram illustrating an arrow with a module in accordance with the teachings of the present invention.
Figure 3:
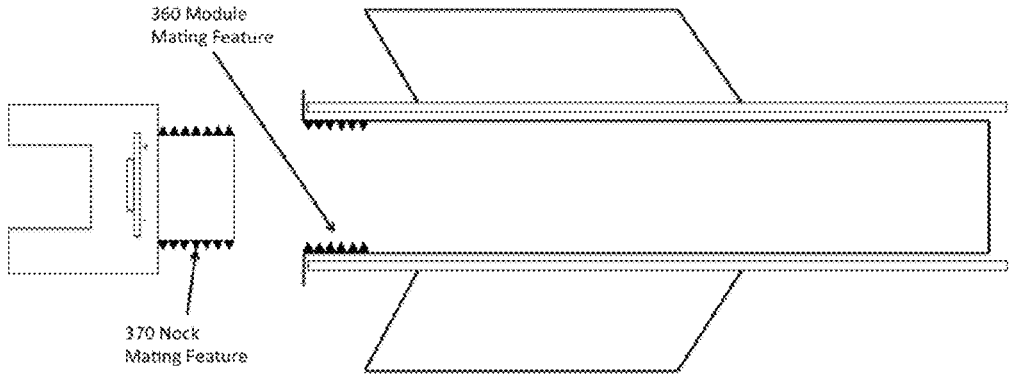

FIG. 2 illustrates a typical arrow 200. The arrow 200 is comprised of a shaft 210, head 240, fletching 220, nock 230, and spline 250. The typical arrow 200 can be modified to include devices that enable the arrow 200 to be tracked while in flight and after flight. FIG. 3 illustrates a close up view of a section of the arrow 300. The arrow 300 is modified by inserting a module 320 into one end of the shaft 310. The module 320 is designed so that it can be inserted into the shaft 310. The module 320 has a cylindrical shape with an open-end 323 and a closed-end 321 opposite the open-end 323. The module 320 is held inside the shaft 310 by a force or interference fit and the module 320 is kept from going too far into the shaft 310 by a lip 311 on the open-end 323 of the module 320. The module 320 also includes a compressive, spring loaded feature 320 inside the shaft and attached to the closed-end 321 of the module 320. The module 320 also includes a mating feature 360 that is used to mate the nock 350 to the module 320.

Figure 4:
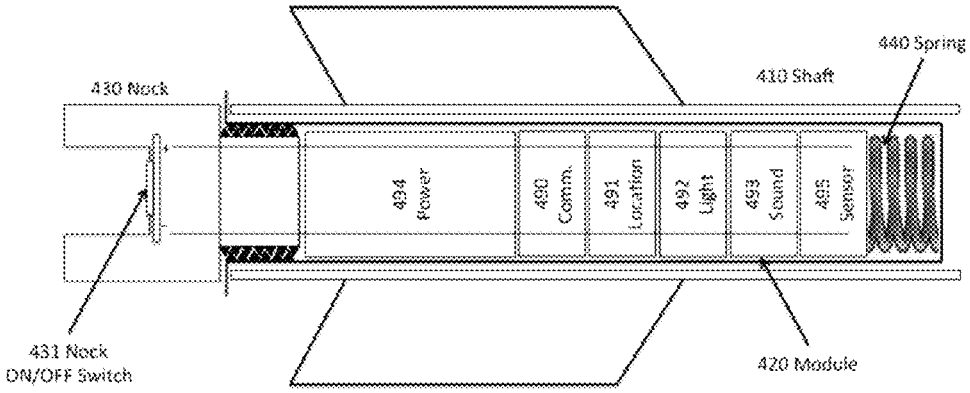
FIG. 4 is a diagram of an exemplary embodiment illustrating an arrow with a module and devices used to track the position of an arrow in accordance with the teachings of the present invention.

FIG. 4 illustrates an embodiment of the invention including an arrow 400 that is designed to enable the arrow to be tracked by emitting a light, sound, and/or communication signal. The arrow 400 includes a module 420 that is inserted into one end of the arrow 400. The module includes several devices including a communication device 490, location-detecting device 491, light-controlling device 492, sound-emitting device 493, and power source 494. The communication device 490, location-detecting device 491, light-controlling device 492, sound-emitting device 493, and power source 494 are designed to fit within the cylinder of the module 420. The communication device 490, location-detecting device 491, light-controlling device 492, sound-emitting device 493, and power source 494 compress the spring 440 within the module and interface with each other in a manner that these individual devices are electrically connected, as required, to each other. For example, the power source 494 is pushed against the sound-emitting device 493 by the force exerted by the compression spring 440. In turn the sound-emitting device 493 is electrically connected to the light-controlling device 492, and light-controlling device 492 is electrically connected to the location-detecting device 491, and the location-detecting device 491 is electrically connected to the communication device 490. If necessary the last device (e.g. the communication device 490) in the module 420 can be connected back to the power source 494 to complete the electrical circuit. The nock 430 may also be used to compress the communication module 490, location-detecting device 491, light-controlling device 492, sound-emitting device 493, and power source 494 against the spring 440. For example, one end of the nock 430 includes a nock-mating feature 435 that interfaces with a module-mating feature 460. Such mating features may include threaded surfaces, snaps, or an interference fit. The spring 440 is optimized to provide a sufficient compressive force to hold the communication device 490, location-detecting device 491, light-controlling device 492, sound-emitting device 493, and power source 494 firmly in place and to ensure the devices are electrically connected.

Figure 5:
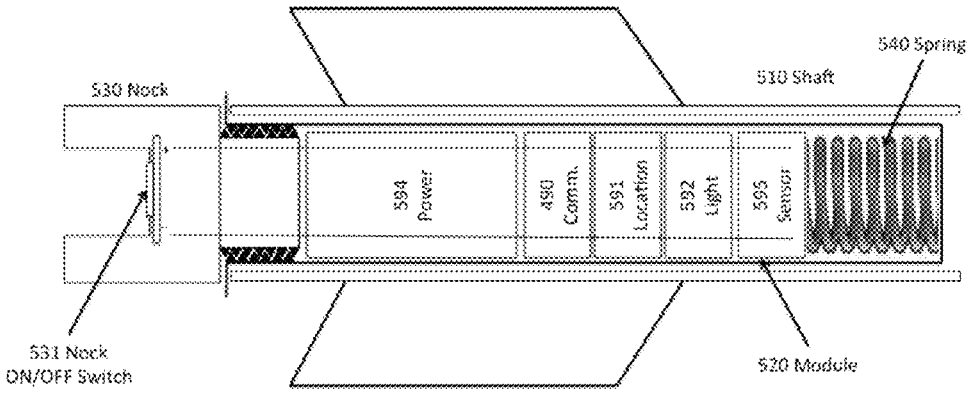
FIG. 5 is a diagram of an exemplary embodiment illustrating an arrow with a module and devices used to track the position of an arrow in accordance with the teachings of the present invention.

FIG. 5 shows another embodiment of the invention wherein fewer devices are placed inside the module 520 to configure the arrow 500 with different tracking methods. For example, the module 520 can be equipped with just a sound-emitting device 593 and power source 494. Other combinations may also be configured by removing or adding different devices. Such configurability could be beneficial in commerce where a basic model can be offered at a lower price and additional devices can be offered as add-on accessories.

Figure 6:
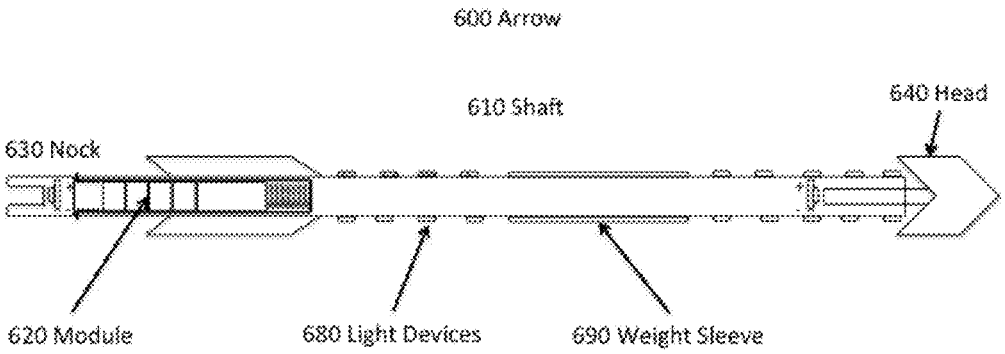
FIG. 6 is a diagram of an exemplary embodiment illustrating an arrow with light elements and weight sleeves on the shaft in accordance with the teachings of the present invention.

FIG. 6 illustrates another embodiment of the invention including an arrow 600 wherein the shaft 610 includes light elements 680 on the surface of the shaft 610. The light elements 680 may include light emitting diodes. Further, the light elements 680 may comprise visible lights of different colors or lights in the infrared spectrum ("IR" lights). The light elements 680 are designed to electrically connect to the power source 694 and the light-controlling device 691, such that the light-controlling device 691 can control the power-on and power-off cycles of the light elements 680. The light elements 680 may be dispersed about the shaft 610 of the arrow 600 in various patterns and quantities. For example, the arrow 600 may include a pattern of several different types and combinations of light elements 680 including different colored and IR lights. The arrow 600 may also include a weight sleeve 690 or several weight sleeves placed on the outside of the shaft 610. The weight sleeves 690 are designed to balance the weight of the arrow 600 so that the weight of the arrow 600 is balanced even when the module 620 is installed inside the shaft 610 of the arrow 600.

Figure 7:
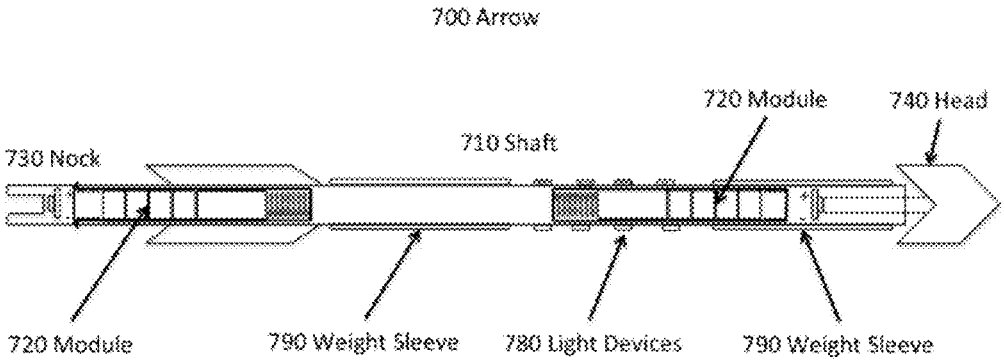
FIG. 7 is a diagram of an exemplary embodiment illustrating an arrow with multiple modules and devices used to track the position of an arrow in accordance with the teachings of the present invention.

FIG. 7 shows an embodiment of the invention where the arrow 700 includes more than one module 720 that are fitted in different spaces along the inside of the shaft 710. The modules 720 are placed at different spaces along the inside of the shaft 710 such that the weight of the modules 720 is dispersed evenly about the length of the arrow's shaft 710. The modules 720 are electrically connected to each other such that the power device 794 can supply power to all the devices inside the module 720 and all the devices can communicate with each other, as needed. In another embodiment each module 720 may have its own power source such that the devices do not need to be electrically connected to each other to obtain power.

The following information further describe the elements of the invention:

Arrow Types

The arrow may be comprised of several different types including arrows designed for hunting, target practice, or even a toy. The arrow may be made from carbon fiber, aluminum, fiberglass, composites, plastic, and wood. The various materials have various advantages and disadvantages. For example, carbon shafts have the advantage of being structurally sound and do not bend or warp, but carbon shafts may be too light in weight to shoot from some bows and are expensive compared to other material types. Aluminum shafts are less expensive than carbon shafts, but aluminum shafts tend to bend and warp with repeated use. Wood shafts are the least expensive option but may have too much variation in weight and size from one arrow to the next and also are structurally weaker than the other material types. The arrow size may also vary including ranging from very short to long with most modern arrows ranging between 22 inches to 30 inches in length. Arrows also come in many types including breasted, bob-tailed, barreled, clout, and target. A breasted arrow is thickest at the area right behind the fletching, and tapers towards the nock and head. A bob-tailed arrow is thickest right behind the head, and tapers to the nock. A barreled arrow is thickest in the center of the arrow. Target arrows are used for target shooting and usually have a simple cylindrical geometry.

Bows

The invention is also applicable to arrows designed for different types of bows. For example, the arrows described by this invention can be used with recurve, reflex, self, longbow, composite, takedown, cross and compound bows.

Crossbow & Bolts

The crossbow is based on the bow and comprises a horizontal bow-like assembly mounted on a stock. The bow shoots arrow-like projectiles commonly referred to as bolts. Bolts may be shorter than arrows, and are typically considerably heavier than an arrow. Bolts designed for use with this invention may be optimized for weight to achieve optimum kinetic energy which may vary depending on the strength and characteristics of the crossbow and consistency in weight and balance. Such bolts may also be stamped with their weight characteristics. Such bolts also do not have a fletching and may be fitted with a variety of heads including sickle-shaped heads or a four-sided point.

Module

The module may be comprised of various shapes although a cylindrical shape is best suited to fit within the shaft of an arrow with an annular cross section. However other cross section shapes may be used including triangular, square, or any other polygon shape. The length of the module can also vary including from less than the full length of the shaft up to the full length of the shaft. The module can also be split into several sections, or several different modules, each being of the same shape and size. The several modules may also be different from each other with different sizes or shapes. The material can also be made of various materials including metals, composites, carbon fiber, plastic, or wood. The module is also designed to be waterproof and otherwise resistant to environmental contaminants such as dust and debris. For example, (referring to FIG. 3) the module may include a seal 313 for sealing the internal components from water, dust, or other contaminants. Various types of sealing mechanisms may be used such as Teflon tape, gaskets, o-rings, laser welding, etc.

On/Off Switch

The devices within the shaft are powered by an internal power source. The power to the devices may be switched on and off with an on/off switch. The on/off switch may be embedded in the end of the nock that interfaces with the string. For example (referring to FIG. 2), the on/off switch 231 embedded in the end of the nock 230 that interfaces with the string (130 referring to FIG. 1) is normally in the off position, but the on/off switch 231 is switched to the on position when the nock 231 is compressed against the spring. In another embodiment, the power source may be turned on when the arrow impacts a target. For example (referring to FIG. 2) the head 240 of the arrow 200 may include an on/off switch 211 at the end of the shaft 210 near the arrow 200. The head 240 is designed such that it can compress the on/off switch 211 when the head 240 impacts a target. In another embodiment an accelerometer sensor 213 may be embedded within the shaft 210. The accelerometer sensor 213 is designed such that it can detect when the arrow 200 is shot from the bow and transmit a signal to the module 200 to power on the devices. As shown in FIG. 4, the accelerometer sensor 495 may alternatively be placed inside the module 420 and powered by the power source 494. In this configuration, the accelerometer sensor 495 is powered by the power source 494, but the other devices are not powered until the accelerometer sensor 213 detects that the arrow has been shot from the bow. In another embodiment (referring to FIG. 1), the power to the devices is powered on by a remote signal sent from a mobile device 150 of the archer 120. In this embodiment, the mobile device 150 sends a signal to the communication device (referring to 490 in FIG. 4) and the communication device 490 transmits a signal to the power source 494 that commands the power source 494 to power the other devices.

Position-Locating Device

The position-locating device 495 may include various position tracking techniques such as GPS, RFID, Bluetooth, cellular triangulation, a positioning system based on magnetic, other sensor data or a network of devices used to wirelessly locate objects, or real time locating systems such wireless LAN systems or other wireless systems. The position-locating device may include passive or active methods to determine location. The position-locating device 495 is configured to operate with the two-way communication device to transmit the absolute or relative position of the arrow to the mobile device enabling the archer to locate the arrow. The signal transmitted by the two-way communication device may be either a private signal such that only a specific mobile device can detect the signal. For example, the signal may be transmitted on a specific frequency that the two-way communication device and mobile device are tuned to transmit and receive signals on. Alternatively the signal may be encrypted by the position-locating device or two-way communication device and decrypted by the mobile device that includes the key to decrypt the encrypted signal. In another embodiment of the invention, the signal transmitted by the two-way communication device may be transmitted via a public medium in which the signal can be detected by other mobile devices (e.g. mobile devices used by others than the archer).

Two-Way Communication Device

The two-way communication device may use an RF, telephony, or ethernet transmitter-receiver, or any transceiver to transmit and receive signals to and from the mobile device.

Power Source

Referring to FIG. 4, the power source 494 may comprise a disposable or rechargeable battery. The power source 494 is sized to provide sufficient power to all of the devices inside the module 420. If a rechargeable battery is used a recharging port 496 is included and accessible from the outside of the shaft 410. The power source may also be recharged using a solar recharging system. For example, the fletching and/or shaft may include energy absorbing materials such as flexible photovoltaic cells that converts the energy of light directly into electricity by the photovoltaic effect. The energy absorbing material is designed to absorb and convert light energy into electricity and then transfer the electricity to the power source 494 (e.g. rechargeable battery).

Sound Emitting Device

Referring to FIG. 4, the sound-emitting device 493 may comprise a speaker, sound emitting diode, piezo electric device, vibrating device, or micro speaker. The sound-emitting device is designed to produce a loud enough sound that the archer would be able to hear the sound as the archer approaches the location of the arrow.

Light Controlling Device

The light-controlling device is designed to control the frequency, pattern, and color of the light devices. The light-controlling device may also be used to control the light devices (680 referring to FIG. 6) and the light embedded in the nock. There may also be a switch on the outside of the shaft that enables the archer to select frequency, pattern, and the color of the light devices. Likewise, the archer may set the frequency, pattern, and the color of the light devices via the mobile device. The light-controlling device may be controlled by a software application installed on the mobile device. In this configuration, the light-controlling device is configured to communicate with the two-way communication device and receive controlling signals from the mobile device.

Light Elements

The light elements 680 on the surface of the shaft 610 may include light emitting diodes. Further, the light elements 680 may comprise visible lights of different colors or lights in the infrared spectrum ("IR" lights). The light elements 680 are designed to electrically connect to the power source 694 and the light-controlling device 691, such that the light-controlling device 691 can control the power-on and power-off cycles of the light elements 680. The light elements 680 may be dispersed about the shaft 610 of the arrow 600 in various patterns and quantities. For example, the arrow 600 may include a pattern of several different types and combinations of light elements 680 including different colored and IR lights. The light elements 680 may also be connected to a light-control switch 695 that enables the archer to select the type (i.e. color or IR), combination, or patter of lights. The light elements 680 may also be controlled by the light-controlling device 691 such that the light elements 680 are powered on while in flight allowing the archer to track the arrow 600 while the arrow 600 is in flight. In one embodiment of this invention, the light elements 680 may include IR lights that are visible only when the archer is using an IR visible device such as IR filtered eyeglass lenses, or a camera enabled to capture IR light.

Software Application

The software application is installed on the mobile device and is enabled to allow the archer to track the arrow during and after flight. The two-way communication device 490 receives a signal from the location-detecting device which is designed to determine the absolute or relative position of the arrow and send a signal with the arrows position data to the communication device. The software application installed on the mobile device is used by the archer to illustrate the position of the arrow either while the arrow is in flight, or when the arrow has landed. The software application may include other functionality such as a remote control that is able to power on the devices inside the module. For example, in this configuration the arrow can be shot from the bow with all of the devices inside the module powered off, thus saving energy use from the power source. The software application may include features that enable the archer to remotely power on devices inside the module when needed, for example after the archer has shot several arrows and is ready to collect such arrows.

Figure 8:
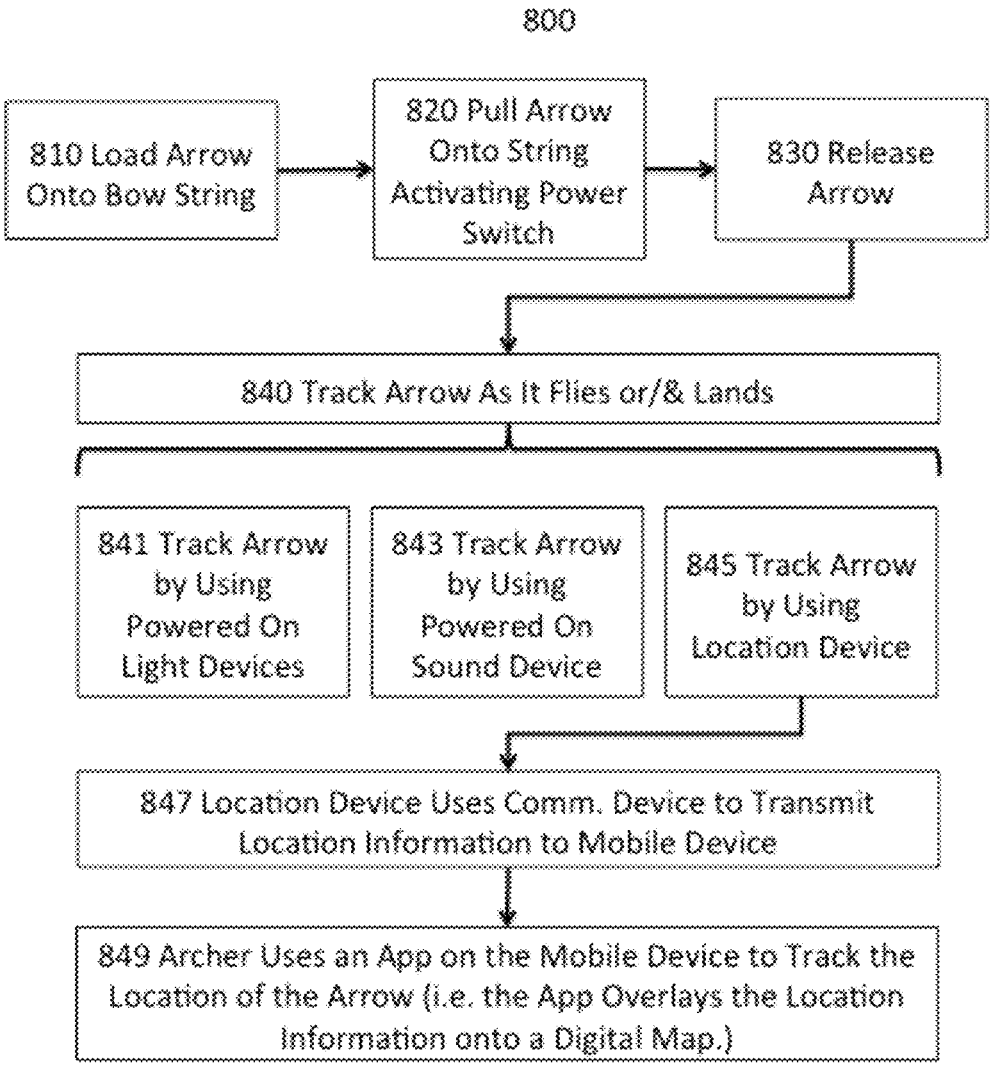
FIG. 8 is a diagram of an exemplary embodiment illustrating the method to track an arrow in flight and after flight in accordance with the teachings of the present invention.

FIG. 8 shows an embodiment of the invention including a method to track an arrow after it is shot from a bow. First the nock of the arrow is attached to the string of the bow. Next the devices (e.g. communication device 490, location-detecting device 491, light-controlling device 492, sound-emitting device 493, and power source 494) inside the module of the arrow are powered on. Next the communication device, location-detecting device, light-controlling device, and sound emitting device are used to track the arrow. For example, the location-detecting device is designed to determine the absolute or relative position of the arrow and sends a signal to the communication device. The communication device then transmits the position of the arrow to a mobile device. A software application installed on the mobile device is used by the archer to illustrate the position of the arrow either while the arrow is in flight, or when the arrow has landed. To help the archer locate the position of the arrow, the light elements may also light up so the arrow is more visible and easier to fine, especially in the dark. Also, the sound-emitting device may make a noise that will further help the archer locate the position of the arrow.

The terms and expressions, which have been employed herein, are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. An arrow comprising:

a head, a shaft, a fletching, and a nock, wherein the shaft includes a module inserted into an end of the shaft;

the module comprising a power source and at least one of the following devices: a position-locating device, a two-way communication device, a sound-emitting device, and a light-controlling device; and wherein the shaft includes a light element on an outside surface of the shaft.

2. The arrow of claim 1, wherein the module is held inside the shaft by an interference fit and the module is kept from going too far into the shaft by a lip protruding outwardly from an open-end of the module that interfaces with an end of the shaft.

3. The arrow of claim 1, wherein the module includes a spring feature attached to an inside surface of a closed-end of the module, the spring feature designed to compress the power source and at least one of the position-locating device, the two-way communication device, the sound-emitting device, and the light-controlling device together in a manner that such devices are electrically connected to each other when such devices are inserted inside the module.

4. The arrow of claim 1, wherein the module includes a mating feature designed to mate the nock to the module.

5. The arrow of claim 4, wherein the nock compresses the power source and at least one of the position-locating device, the two-way communication device, the sound-emitting device, and the light-controlling device against a spring such that the spring is optimized to provide a sufficient compressive force to hold such devices firmly in place and to ensure such devices are electrically connected.

6. The arrow of claim 1, wherein the light element comprises a light emitting diode.

7. The arrow of claim 1, wherein the light element comprises a light in the infrared spectrum.

8. The arrow of claim 1, wherein the light element are designed to electrically connect to the power source and the light-controlling device, such that the light-controlling device controls the power-on and power-off cycles of the light element.

9. The arrow of claim 1, wherein the light element is placed about the shaft of the arrow in various patterns and quantities including a pattern of several different types and combinations of light elements including different colors and infrared lights.

10. The arrow of claim 1, wherein a weight sleeve is placed on an outside surface of the shaft, the weight sleeve designed to balance a weight of the arrow so the weight of the arrow is balanced when the module is installed inside the shaft.

11. The arrow of claim 1, wherein the arrow includes more than one module fitted in different spaces along the inside of the shaft such that the weight of the modules is dispersed evenly about the length of the shaft.

12. The arrow of claim 11, wherein the more than one modules are electrically connected to each other such that the power source supplies power to all devices inside the modules and such devices communicate with each other.

13. The arrow of claim 1, wherein the power source may be switched on and off with an on/off switch.

14. The arrow of claim 13, wherein the on/off switch is embedded in an end of the nock that interfaces with a string of a bow such that the off/off switch is switched to an on position when the nock is pressed against the spring.

15. The arrow of claim 13, wherein the head of the arrow includes an on/off switch at the end of the shaft near the head and the head is designed such that it activates the on/off switch when the head impacts a target.

16. The arrow of claim 13, wherein an accelerometer sensor is embedded within the shaft and is designed such that the accelerometer sensor detects when the arrow is shot from a bow and transmit a signal to power on the on/off switch.

17. The arrow of claim 13, wherein a mobile device sends a signal to the communication device and the communication device transmits a signal to power on the on/off switch.

* * * * *